United States Patent [19]

Gates et al.

[11] 4,028,577

[45] June 7, 1977

[54] ELECTRIC LAMP WITH INSULATING BASE

[75] Inventors: Paul E. Gates, Danvers; Stephen F. Kimball, Georgetown; Stephen J. Leadvaro, Salem, all of Mass.

[73] Assignee: GTE Sylvania Incorporated, Salem, Mass.

[22] Filed: June 23, 1976

[21] Appl. No.: 699,118

Related U.S. Application Data

[63] Continuation-in-part of Ser. No. 572,609, April 28, 1975, Pat. No. 3,979,627.

[52] U.S. Cl. ..... 313/318; 313/315; 339/144 R; 339/145 R

[51] Int. Cl.[2] ..... H01J 5/48; H01J 5/50

[58] Field of Search ..... 313/318, 315; 339/144 R, 145

[56] References Cited

UNITED STATES PATENTS

| | | | |
|---|---|---|---|
| 3,619,702 | 11/1971 | Albrecht | 313/318 |
| 3,673,453 | 6/1972 | Prijn et al. | 313/318 |
| 3,800,377 | 4/1974 | Palmen | 313/318 |
| 3,829,729 | 8/1974 | Westlund, Jr. et al. | 313/318 |

*Primary Examiner*—Saxfield Chatmon, Jr.
*Attorney, Agent, or Firm*—Edward J. Coleman

[57] ABSTRACT

An electric lamp having a light-transmitting envelope, such as a glass bulb, secured to a plastic base having a symmetrical wedge-lock portion. Lead-in wires from the glass bulb are threaded through channels in the plastic base and extend alongside the wedge-lock portion to form contacts without soldering.

10 Claims, 8 Drawing Figures

ELECTRIC LAMP WITH INSULATING BASE

CROSS-REFERENCE TO RELATED APPLICATION

This is a continuation-in-part of application Ser. No. 572,609, filed Apr. 28, 1975, now U.S. Pat. No. 3,979,627.

BACKGROUND OF THE INVENTION

This invention relates to electric lamps and, more particularly, to an improved base for such lamps.

The features of the present invention are particularly useful as applied to the construction of the incandescent lamps employed in automobiles, such as the dual-filament lamps employed in tail light assemblies. Prior lamps of this type generally employed a type S-8 glass bulb cemented in a brass doubled contact bayonet base. Although used for a number of years, such bases pose a number of disadvantages. For example, anyone who has replaced such a lamp in their automobile will appreciate the great difficulty experienced in position-referencing the base to insure the proper lamp-to-socket orientation. The base is cylindrical and the only orientation reference means are small indexing pins at the sides of the base. This referencing problem also holds true for automatic insertion of the lamp into the socket during production assembly. Further, the lamp to base construction for the dual filament lamp requires three soldering points for electrical connections (the two lead-in wires serving as the common connection are twisted and soldered to the sidewall of the base, while the other two wires are respectively soldered to the twin contact nodes at the bottom of the base). This leads to corrosion or other contact degradation problems caused by soldering fluxes. Finally, the bayonet base lamp requires a somewhat complicated and relatively expensive socket design.

BRIEF SUMMARY OF THE INVENTION

Accordingly, it is an object of the present invention to provide an electric lamp with improved base construction.

It is a particular object to provide a lamp with an improved base that can be loaded into its socket more readily than the prior art lamp, use a less expensive socket, eliminate soldering problems, and reduce base and socket corrosion problems, which in turn cause electrical problems.

These and other objects, advantages and features are attained, in accordance with the principles of this invention, by an electric lamp having a light-transmitting envelope with a sealed end portion which is secured in an insulating base member having a cylindrical cavity and a depending wedge-lock portion. A plurality of lead-in wires extending through the sealed end portion of the lamp envelope are threaded into respective channels passing through the bottom of the cylindrical cavity. Each of the wires have a terminal portion which extends outwardly from the bottom of the cylindrical cavity and proceeds alongside the wedgelock portion from the top to the bottom thereof. The base locating means are symmetrically disposed on opposed flat sides of the sedge-lock portion, and the lead-in wires along each side of the wedge-lock portion function as the lamp contacts without the need for solder joints. The base may be formed of plastic, with a conventional lamp bulb being cemented within a cavity thereof, thereby inexpensively providing a substantially improved lamp construction which can easily be oriented into a relatively simple socket construction.

BRIEF DESCRIPTION OF THE DRAWINGS

The invention will be more fully described hereinafter in conjunction with the accompanying drawings, in which.

DESCRIPTION OF PREFERRED EMBODIMENT

Figure 1:
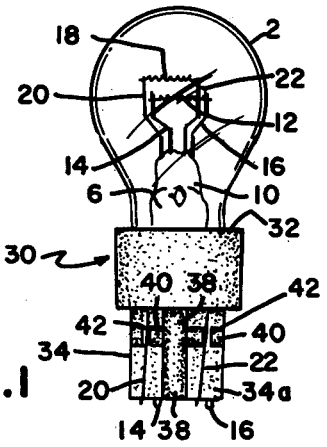
FIG. 1 is a front elevational view of one embodiment of an incandescent lamp with an insulating base.

Referring to FIGS. 1–4, a lamp according to the aforementioned parent application is shown comprising a light-transmitting envelope in the form of a glass bulb 2 having a dual filament mount structure sealed into one end thereof. The envelope is filled with a rare gas, such as argon, at approximately atmospheric pressure and thereafter hermetically sealed in the usual manner by tipping off the exhaust tube 4 (see FIG. 4) at the sealed end of the lamp.

The mount structure includes the typical reentrant glass stem 6 having at one end a flare portion 8 (FIG. 4) which is sealed about its periphery to the end of the glass bulb 2, and a press 10 at the inward end supporting a pair of filament mount structures. More specifically, a first coiled filament 12 is supported by an electrically connected to a pair of lead-in wires 14 and 16 sealed through the stem press 10, and a second coiled filament 18 is supported by and electrically connected to a pair of lead-in wires 20 and 22 sealed through the stem press. Each filament spans the inner ends of its respective pair of lead-in wires, with the ends of the coiled filament being clamped by the lead-in wires to provide the electrical connection thereto.

The lamp is provided with a base member formed of an electrically insulating material such as plastic or ceramic. Preferably, the base is of a one-piece molded construction 30 having a cylindrical cavity 32 that is larger than the sealed end portion of the envelope and a depending wedge-lock portion 34. The wedge-lock portion has opposed substantially flat sides **34*a* and 34*b* with locating means symmetrically formed on each of the opposed sides. In this instance, the locating means on each side comprise a central axial rib 38 and a transverse rib 40. When the base is inserted in a socket, the set central ribs 38 serve as a centering key, and the set of transverse ribs 40** provide lock-in means.

Figure 2:
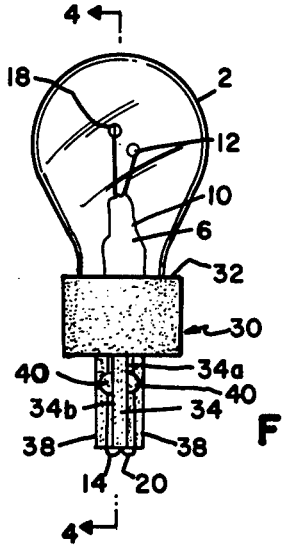
FIG. 2 is a side view of the lamp of FIG. 1.
Figure 3:
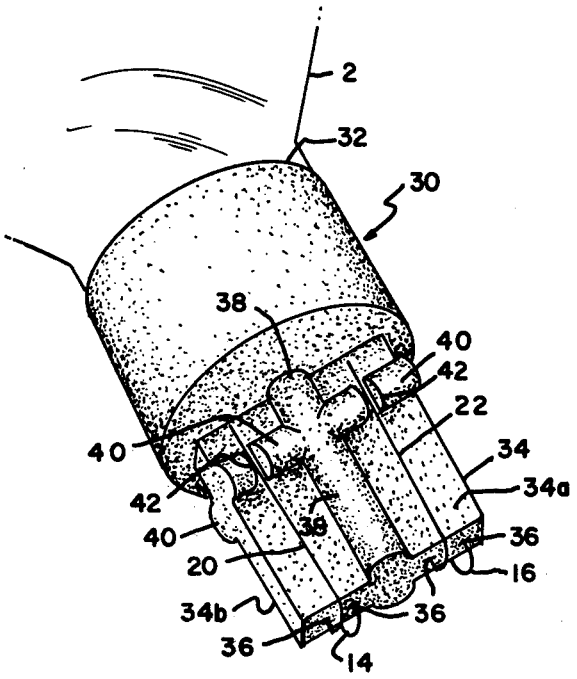
FIG. 3 is a fragmentary perspective view of the base end of the lamp of FIG. 1 on a greatly enlarged scale.
Figure 4:
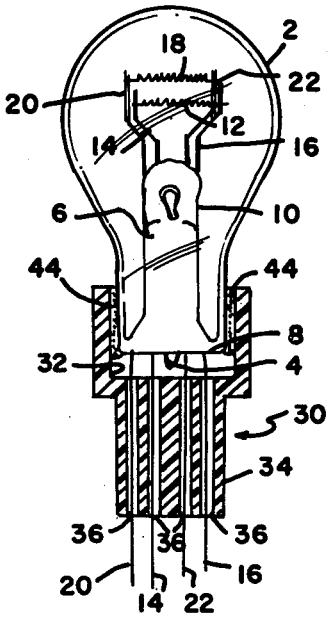
FIG. 4 is a sectional view on line 4—4 of FIG. 2 showing the base cavity and lead channels, but with the lead-in wires shown in their initial straightened position prior to bending about the wedge-lock portion, and with the lamp bulb shown in elevation.

As best shown in FIG. 4, a plurality of lead channels 36, in this case four, pass through the wedge-lock portion of the base member and communicate with the cavity 32. The sealed end portion of the lamp envelope is seated within the cavity 32, while the lead-in wires 14, 16, 20 and 22 extending from the lamp seal are threaded into and through respective ones of the channels 36. The terminal portions of the lead-in wires extending outwardly from the end of the wedge-lock portion 34 are then bent around the lower end of the base and directed to extend alongside the parallel to the flat sides thereof and terminate past the transverse lock-in rib 40. More specifically, as illustrated in FIGS. 1, 2 and 3, the terminal portions of lead-in wires 20 and 22 are directed to extend alongside and parallel to the flat side 34a of the wedge-lock portion of the base, while the terminal portions of lead-in wires 14 and 16 are directed to extend alongside and parallel to the other of the flat sides, i.e., side 34*b*. Each of the transverse ribs 40 has a pair of slots 42 for accommodating the terminal portions of the pair of lead wires extending on the side on which the rib formed. Thus, the terminal portions of wires 20 and 22 lie in respective slots 42 and terminate past the rib 40 on side 34*a*, while the terminal portions of wires 14 and 16 lie in respective slots 42 (not shown) and terminate past the rib 40 on side 34*b*.

Although it is possible in a given application that the glass lamp bulb 2 may be secured within the cylindrical base cavity 32 by the bent around lead-in wires, it is preferred that the bulb be secured within the base by a layer of cement 44 (FIG. 4) between the sealed end portion of the bulb and cavity 32.

FIGS. 5–8 illustrate a second embodiment of a lamp according to the invention. The construction is similar in many respects to that described and shown in FIGS. 1–4, with the same numerals being used to identify like elements. In this instance, however, the lead-in wires are exited through short channels in the bottom of the cylindrical cavity portion, rather than being threaded through long channels in the wedge-lock portion. Accordingly, the one-piece molded base of FIGS. 5–8 is denoted as 30′ having a cylindrical cavity 32′ and a depending wedge-lock portion 34′. The opposed substantially flat sides of the wedge-lock portion continue to be denoted as 34*a* and 34*b* since these surfaces are the same as the corresponding sides of FIGS. 1–4.

Figure 5:
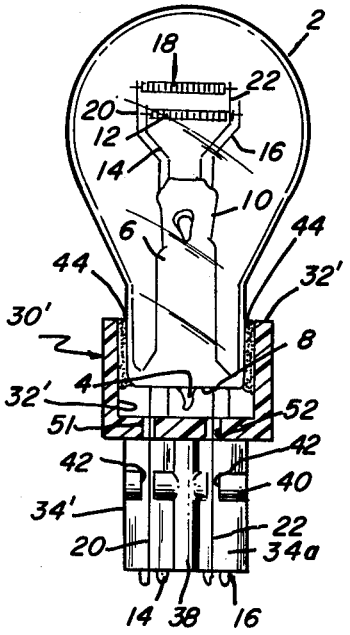
FIG. 5 is a front elevational view, partly in section, of another embodiment of an incandescent lamp with an insulating base in accordance with the invention.
Figure 6:
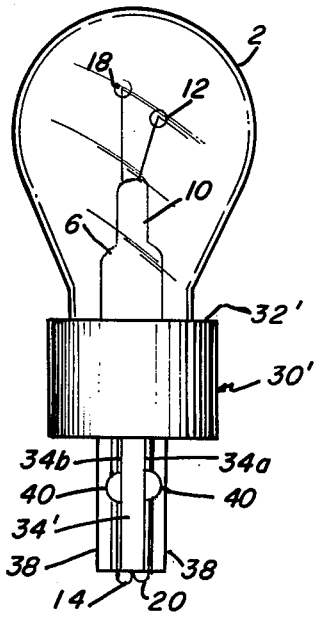
FIG. 6 is a side view of the lamp of FIG. 5.
Figure 7:
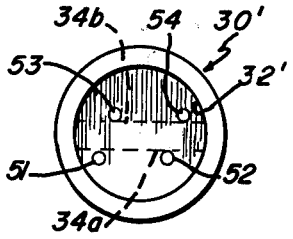
FIG. 7 is a top view of the insulating base of FIG. 5 with the lamp removed; and, FIG. 8 is a fragmentary perspective view of the base end of the lamp of FIG. 5 on greatly enlarged scale.
Figure 8:
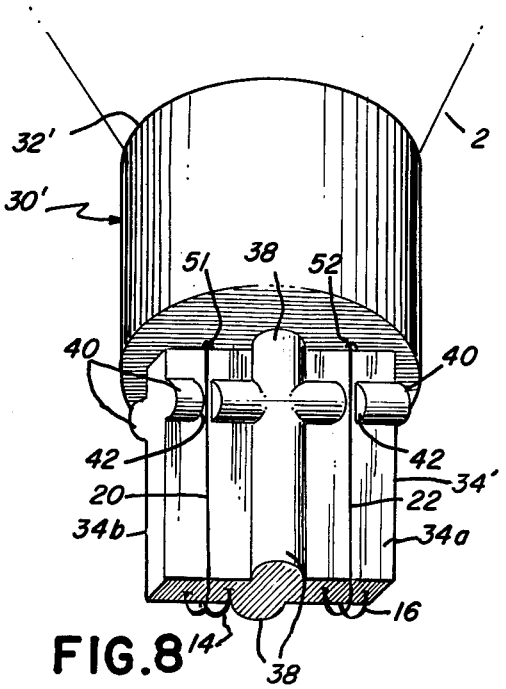

As illustrated by FIGS. 5, 7 and 8, a plurality of lead channels 51–54, in this case four, pass through the bottom of the cylindrical cavity 32′ and exit adjacent to the top of the wedge lock portion 34′. More specifically, as best shown in the top view of cavity 32′ in FIG. 7 (the lamp being removed), channels 51 and 52 exit to side 34*a* of the wedge-lock, and offset channels 53 and 54 exit to side 34*b*. The sealed end portion of the lamp envelope is seated within the cavity 32′, while the lead-in wires 20 and 22 extending from the lamp seal are threaded into and through channels 51 and 52, respectively, and the lamp lead-in wires 14 and 16 are passed through channels 53 and 54. The terminal portions of the lead-in wires 20 and 22 extend outwardly from the bottom of the cavity and proceed alongside and parallel to the flat side 34*a* of the wedge-lock portion of the base from the top to the bottom thereof, while the terminal portion of the lead-in wires 14 and 16 extend outwardly from the bottom of the cavity and proceed alongside and parallel to the other of the flat sides, i.e., side 34*b*, from the top to the bottom thereof. As previously described, each of the transverse lock-in ribs 40 has a pair of slots 42 for accommodating the terminal portions of the pair of lead-in wires extending on the side of the wedge-lock on which the rib is formed. Thus, the terminal portions of wires 20 and 22 lie in respective slots 42 and extend past the transverse lock-in rib 40 on side 34*a*, with the ends of these wires engaging the bottom of the wedge-lock portion 34′. For example, the ends of the wires can be wrapped around or secured at the bottom edge of the wedge-lock portion, as by heat staking the ends of the wires into the plastic material thereat, as best shown in FIG. 8. In like manner, the terminal portions of wires 14 and 16 lie in respective slots 42 (not shown) and extend past the rib 40 on side 34*b*, with the ends of the wires engaging the bottom of the wedge-lock.

Again, although it is possible in a given application that the glass lamp bulb 2 may be secured within the cylindrical base cavity 32′ by the secured lead-in wires, it is preferred that the bulb be fixed within the base by a layer of cement 44 (FIG. 5) between the sealed end portion of the bulb and cavity 32′.

According to one specific embodiment, a type S-8 dualfilament automotive lamp bulb 2 is mounted in a single-piece plastic base 30′ formed of Bakelite. The bulb envelope 2 is formed of a lime glass, while the reentrant stem is of Corning type 0120 lead glass. The tungsten filaments 12 and 18 are mounted on dumet lead-in wires 14, 16, 20 and 22, and the bulb is filled with argon at about atmospheric pressure. The base is formed as shown in FIGS. 5–8, and the lead-in wires are threaded through the base cavity 32′ and disposed along the wedge-lock 34 as illustrated. A conventional lamp cement 44 is used to secure the sealed end portion of the bulb within the base cavity 32′.

This improved base design permits ready conversion of existing lamp bulb types, with the lead-in wires functioning as electrical contacts, thereby eliminating the need for soldering. The base is symmetrically formed so that it can be easily oriented for machine loading into sockets, which are now permitted to be of a more simplified and less expensive construction. Further the insulating base with solderless contacts significantly minimizes base and socket corrosion problems.

Although the invention has been described with respect to a specific embodiment, it will be appreciated that modifications and changes may be made by those skilled in the art without departing from the true spirit and scope of the invention. For example, the improved base is obviously not limited to lamps with dual filaments but may be readily employed with single filament lamps. The base can be non-symmetrical to assure installation in one direction only.

What we claim is:

1. An electric lamp comprising, in combination:

an hermetically sealed, light-transmitting envelope containing an energizable source of light and having a sealed portion at one end;

an insulting base member having a cylindrical cavity that is larger than the sealed end portion of said envelope, a wedge-lock portion depending from the bottom of said cavity, said wedge-lock portion having opposed substantially flat sides with locating means, including a transverse lock-in rib, formed on each of said opposed flat sides, and a plurality of channels passing through the bottom of said cylindrical cavity, said sealed end portion of the envelope being secured within said base cavity; and a plurality of lead-in wires extending through the sealed end portion of said envelope and into the respective channels in the bottom of said cylindrical cavity, each of said lead-in wires having a terminal portion extending outwardly from the bottom of said cavity and proceeding alongside said wedge-lock portion from the top to the bottom thereof, the terminal portion of at least a first one of said lead-in wires extending alongside and approximately parallel to one of said flat sides past the transverse lock-in rib thereon and engaging the bottom of said wedge-lock portion, and the terminal portion of at least a second one of said lead-in wires extending alongside and approximately parallel to the other of said flat sides past the transverse lock-in rib thereon and engaging the bottom of said wedge-lock portion.

2. A lamp according to claim 1 wherein said energizable source of light comprises a pair of filaments each of which is connected to a respective pair of said lead-in wires, whereby four lead-in wires extend through the sealed end portion of said envelope into four respective channels in the bottom of said cylindrical cavity, and the terminal portions of a first pair of said lead-in wires extend alongside and approximately parallel to one of the flat sides of said wedge-lock portion, and the terminal portions of a second pair of said lead-in wires extend alongside and approximately parallel to the other of the flat sides of said wedge-lock portion.

3. A lamp according to claim 2 wherein said base member is formed of a plastic material, and said sealed end portion of said envelope is secured within said plastic base cavity by a layer of cement therebetween.

4. A lamp according to claim 1 wherein said envelope is a glass bulb, said sealed end portion of the envelope comprises a reentrant glass stem, and said base member is formed of plastic.

5. The lamp according to claim 4 wherein said energizable source of light comprises a pair of filaments each of which is connected to a respective pair of lead-in wires, whereby four lead-in wires extend through the reentrant stem of said envelope into four respective channels in the bottom of said cylindrical cavity, and the terminal portions of a first pair of said lead-in wires extend alongside and approximately parallel to one of the flat sides of said wedge-lock portion, and the terminal portions of a second pair of said lead-in wires extend alongside and approximately parallel to the other of the flat sides of said wedge-lock portion.

6. A lamp according to claim 5 wherein said locating means comprise a central axial rib and said transverse rib symmetrically formed on each of the opposed flat sides of the wedge-lock portion of said plastic base member.

7. A lamp according to claim 6 wherein each of said transverse ribs has a pair of slots for accommodating the terminal portions of the pair of lead-in wires extending alongside and parallel to the respective flat side of the wedge-lock on which the rib is formed, the terminal portions of said lead-in wires lying in the respective slots in said transverse ribs and engaging the bottom of said wedge-lock portion.

8. A lamp according to claim 4 wherein the sealed end portion of said glass bulb is secured within the cylindrical cavity of said plastic base by a layer of cement therebetween.

9. A lamp according to claim 1 wherein said locating means comprise a central axial rib and said transverse lock-in rib symmetrically formed on each of the opposed flat sides of the wedge-lock portion of said insulating base member.

10. A lamp according to claim 9 wherein each of said transverse ribs has at least one slot for accommodating the terminal portion of the lead-in wire extending alongside and parallel to the respective flat side of the wedge-lock on which the rib is formed, the terminal portions of said lead-in wires lying in the respective slots in said transverse ribs and extending past said transverse ribs and engaging the bottom of said wedge-lock portion.

* * * * *